US006322352B1

(12) United States Patent
Zink

(10) Patent No.: US 6,322,352 B1
(45) Date of Patent: Nov. 27, 2001

(54) GAS BURNER SYSTEM

(75) Inventor: Robert Zink, Hagen (DE)

(73) Assignee: Isphording Germany GmbH, Attendorn (DE)

( * ) Notice: Subject to any disclaimer, the term of this patent is extended or adjusted under 35 U.S.C. 154(b) by 0 days.

(21) Appl. No.: 09/327,991

(22) Filed: Jun. 8, 1999

(30) Foreign Application Priority Data

Jun. 10, 1998 (DE) ..... 198 25 846

(51) Int. Cl.[7] ..... F23N 5/00

(52) U.S. Cl. ..... 431/27; 431/28; 431/78; 431/81; 431/82; 431/69; 137/66; 126/39 BA

(58) Field of Search ..... 431/27, 28–72, 431/74, 75, 77, 78, 80, 81, 69, 82; 126/39 BA, 39 E; 137/65, 66

(56) References Cited

U.S. PATENT DOCUMENTS

| | | | | |
|---|---|---|---|---|
| 3,155,145 | | 11/1964 | La Pointe et al. . | |
| 3,162,430 | * | 12/1964 | Wilkerson | 431/27 |
| 3,762,639 | * | 10/1973 | Katchka et al. | 431/285 |
| 3,875,956 | * | 4/1975 | Katchka | 137/65 |
| 3,975,136 | * | 8/1976 | Baysinger et al. | 431/27 |
| 4,147,494 | * | 4/1979 | Ando et al. | 431/80 |
| 4,257,758 | * | 3/1981 | Blomberg | 431/27 |
| 4,543,974 | * | 10/1985 | Dietiker et al. | 137/66 |
| 5,018,964 | | 5/1991 | Shah Reza H . | |
| 5,085,573 | * | 2/1992 | Geary | 431/27 |
| 5,375,585 | | 12/1994 | Home . | |

FOREIGN PATENT DOCUMENTS

| | | | |
|---|---|---|---|
| 23 41 591 | | 2/1975 | (DE) . |
| 93 00 162.2 | | 5/1993 | (DE) . |
| 93 07 895.1 | | 9/1993 | (DE) . |
| 0 635 680 | * | 1/1995 | (EP) . |
| 0 803 680 | | 10/1997 | (EP) . |
| 2 249 383 | | 5/1992 | (GB) . |
| 59-125332 | * | 7/1984 | (JP) . |

* cited by examiner

*Primary Examiner*—Ira S. Lazarus
*Assistant Examiner*—Josiah C. Cocks
(74) *Attorney, Agent, or Firm*—Herbert Dubno

(57) ABSTRACT

A stove burner safety system has an electromagnetic valve and a manual gas cock controlling the gas flow to the burner and a spark plug adjacent the burner which receives a spark pulse from the electric circuitry which also controls an electromagnetic valve. When the stem of the manual valve is actuated a switch turns on the electric module and when a flame failure is detected a train of a certain number of spark pulses is supplied to the spark plug and if reignition does not occur within a certain number of pulse or a certain time, the electromagnetic valve is turned off.

9 Claims, 5 Drawing Sheets

GAS BURNER SYSTEM

FIELD OF THE INVENTION

The present invention relates to a safety system for gas burners and, more particularly to a device for ensuring the operational safety of a gas burner station.

More particularly, the invention relates to a gas burner system with improved security against the release of unburned fuel gas in an arrangement in which the supply line to the burner includes a manually operated valve, an electromagnetic valve in addition to the manually operated valve and which shuts off the gas supply to the burner upon extinction of the flame, and a spark igniter or spark plug which ignites the gas and which signals when gas is released unburned.

BACKGROUND OF THE INVENTION

There are various systems available for preventing the release of fuel gas unburned from or burner. A gas valve with a magnetic control can be provided in combination with a temperature responsive element, for example, a bimetallic element or thermocouple, to generate an electric current while a gas flame remains lit to supply the magnetically operated valve and maintain the spring loaded valve open as long as the gas flame heats the sensor tip of the thermal element. Should the gas flame be extinguished at the burner the temperature of the flame is no longer detectable by the tip of the sensor and the gas valve can automatically close by the action of the spring to shut off the supply of gas to the burner.

This system has the drawback that the gas valve is operated via a stem which is depressed manually and must be held in until the electric current generated by the thermal element is sufficient to retain the magnetic valve in the open position. In most instances, it is necessary to depress the stem or plunger for up to 10 seconds before the valve will be retained in its open state.

Another drawback is that, upon extinction of the flame at the burner, the closure of the gas valve may take up to 90 seconds so that over this period of time unburned gas can be released into the atmosphere from the burner. Furthermore, the way in which the thermoelement must be mounted on the burner can be comparatively expensive and, with time, the sensor tip of the thermal element can be damaged or soiled and can become unusable.

Another approach, with a burner having no automatic shutoff is to provide for ionization ignition by a spark plug at the burner. An electric amplifier measures the current between the spark plug at the burner and a burner covered and the degree of ionization thus measured can indicate whether the gas flame is present or if a gas flame is absent where a gas flame is found to be absent by this system, the spark plug is triggered to reignite the burner. In this case, if a train of ignition pulses is transmitted to the spark plug after the gas flame has been extinguished and the flame is not reignited, unburned gas continues to flow out of the burner during the period. The gas supply then can be cutoff only by manual operation of the gas cook. In the case of a defective burner, removal or loss of the burner cover or even partial blockage of gas outlet openings, the spark generating igniter can fire without igniting the gas so that the gas can flow unburned from the burner.

OBJECTS OF THE INVENTION

It is the principal object of the present invention to provide an improved safety system for gas burners which prevents the escape of unburned fuel gas at a gas-cooking station, thereby automatically and rapidly interrupting the outflow of gas as soon as a dangerous condition can arise.

Another object of the invention is to provide a significant reduction in the duration over which unburned gas can be released from a burner in the event a gas burner flame is extinguished or is not ignited.

SUMMARY OF THE INVENTION

These objects and others which will become apparent hereinafter are attained, in accordance with the invention, in a system of the type described in which an electronic controller is provided between an electromagnetic valve in the burner supply line and the spark plug which, in response to the detection of a failure of the burner flame, will send a train of trigger pulses to the spark plug to generate respective sparks and if reignition is not possible, will then cut off the electromagnetic valve. More particularly, the electromagnetic valve and the spark igniter are connected with an electronic controller which shuts off the flow of unburned fuel gas within a predetermined time period or after a certain number of reignition attempts following detection of the extinguishing of the burner flame. With the system of the invention, the construction of the assembly is simple but reliability is greatly enhanced, especially when the rotation current maintaining the electromagnetic valve in its open state is produced by the control device.

Preferably, the retention of the spring loaded electromagnetic valve in its open state is triggered by a single depression or actuation of the swinging stem of the manually operated valve also connected in the gas supply line. The stem may be connected to a switch, especially a microswitch, to turn on and off the controller.

More particularly, a gas burner system according to the invention can comprise:

- a gas burner;
- a gas supply line connected to the gas burner for supply a fuel gas thereto;
- an electromagnetic valve connected in the gas supply line for shutting off a supply of gas to the burner upon extinguishing of a burner flame;
- a spark generator at the burner receiving a voltage pulse for producing a spark to ignite the flame at the burner and for signaling discharge of unburned fuel gas therefrom; and
- an electronic controller connected between the spark generator and the electromagnetic valve for automatically triggering a series of voltage pulses producing respective sparks to attempt to ignite unburned fuel gas and, upon a failure of ignition within a predetermined time interval or after a predetermined number of pulses, closing the electromagnetic valve.

The electrocontroller generates a retention current maintaining the electromagnetic valve in an open state over an entire duration of the burner flame.

The electromagnetic valve is spring biased toward a closed state and the system further comprises a manually operable valve connected in the line, the manually operable valve having a valve stem producing, upon a single actuation of the stem, a retention current maintaining the electromagnetic valve in an open state over an entire duration of the burner flame.

The manually operated valve can have a housing in which the electromagnetic valve is located. The burner can be one of a plurality of such burners and only those of the plurality which are not reignitable by the train of pulses can be shut off from the gas supply by the electric controller.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
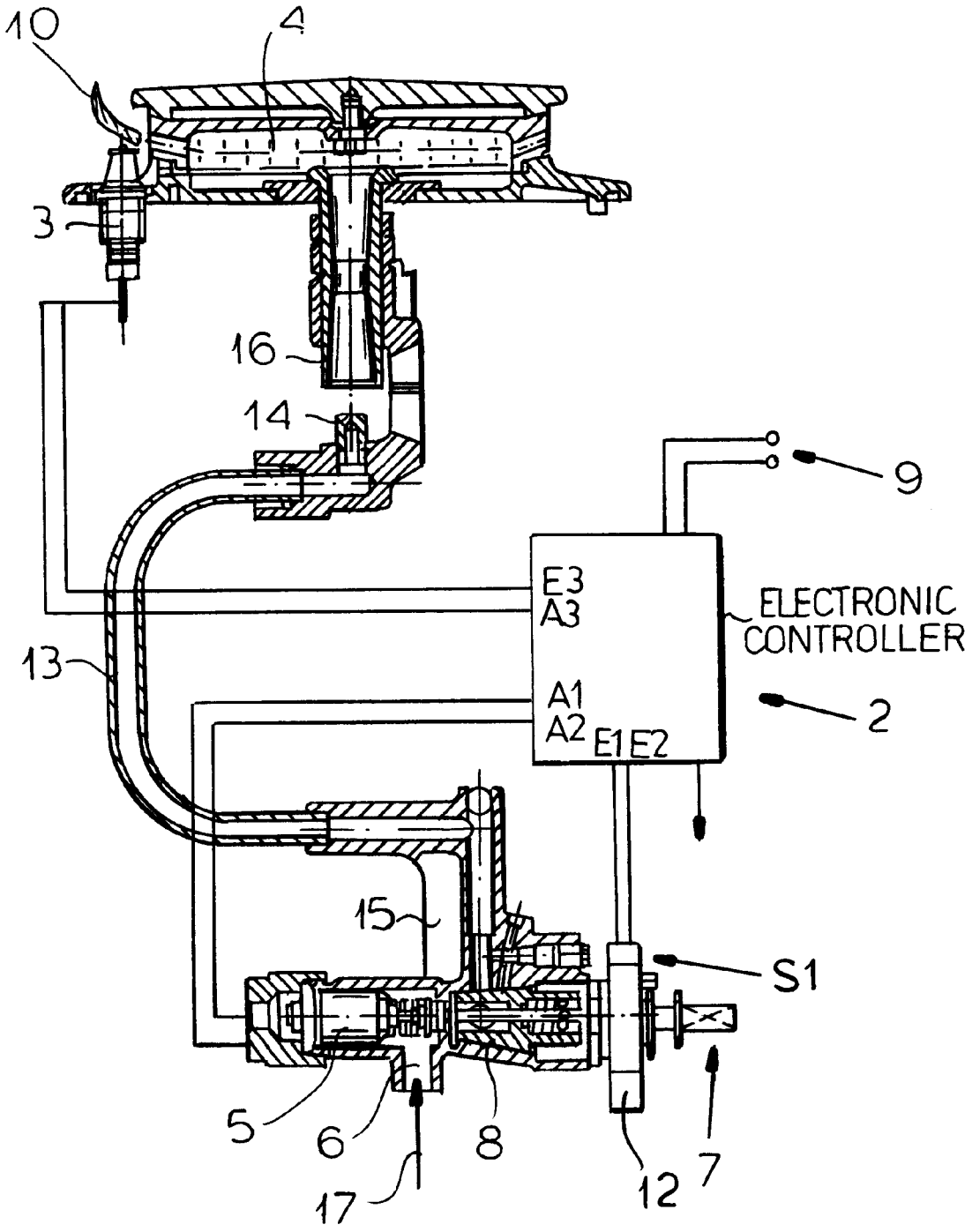
FIG. 1 is a diagrammatical cross sectional view of a burner system according to the invention showing the gas cock, the microswitch, the electric module, the spark plug and the gas burner.

The apparatus of FIG. 1 comprises an electromagnetic valve 5 which is connected in a supply line to a burner 4 and has its electrical side connected to the terminals A1 and A2 of an electrocontroller 2 which may be provided as a module in a separate box outside the housing of the electromagnetic valve 5. The latter can be built into the housing of a manual valve or cock 8 whose actuating stem is represented at 7 and which is connected via a microswitch to the electric controller 2 at the terminals E1 and E2 thereof. The terminals E3 and A3 can be connected to a spark plug 3 at the burner 4, positioned to ignite a flame at the burner which, as shown, can be a standard cooking burner. A gas nozzle 14 in the line 13 connecting the housing 15 of the valve 5/8 to the burner, can open into a tube 16 through which air can be induced by the gas jet to flow so as to mix with the gas before combustion. The electronic controller is supplied with power at 9 and the gas can be supplied from a source 17 via the fitting 6 of the housing 15 to the burner.

When a spark jumps at the plug 3, gas emerging from a burner orifice is ignited. The spark plug 3 also serves to monitor the gas at the burner and, upon extinction of the gas flame, the burner is automatically reignited by a train of igniting pulses by the controller to the spark plug. When reignition does not occur within a predetermined time interval or a predetermined number of sparks or ignition pulses or reignition attempts, there is immediate interruption in the current supplied by the module 2 to the electromagnet so that unburned gas will cease flowing from the burner. By rotation of the stem 7 of the cock 8 into the closed position, the switch cuts off the electric controller and thus permits the electromagnetic valve 5 to close.

When the stem 7 is actuated, the electric controller is turned on and a retention current is supplied by the controller to the electromagnetic valve 5 to maintain the latter in its closed position against the force of a spring therein. The rotation of the stem 7 and the opening of the valve 8, however, by itself does not open the path via the line 13 to the burner 4 from the source 7 since the electromagnetic valve 5 remains closed until the stem 7 is axially depressed or actuated a single time, thereby supplying current from the module 2 to the electromagnetic valve 5, opening this valve and supplying the burner. The actuation of the stem 7 axially by a single depression produces the pulse at the spark plug 3 which ignites the flame.

When the burner 4 is to be turned off the stem 7 is rotated into the off position and the module 2 interrupts the current supply to the electromagnetic valve, the latter then closing.

In the operation of the burner of the invention, the following states can rise, which do not effect the reliability of the system:

a) There can be a failure of voltage supply at 9. The electric controller 2 is shut down and electromagnetic valve 5 is closed. Gas cannot flow out from the burner.

b) The current supply 9 can be interrupted during normal operation. Magnetic valve 5 automatically shuts down and gas cannot flow from the burner (see (a)).

c) The electrical connection between the module 2 and the spark generator 3 can be interrupted (A3/E3). No further ionization current flows between electrodes. The module 2 treats the event as a failure of the flame and shuts down the electromagnetic valve 5.

d) The electrical connection between the electromagnetic valve 5 and the module 2 can be interrupted (A1/A2). Gas supply is instantaneously halted.

e) The electrical connection between the switch (S1, 12) and the module 2 can be interrupted. Gas supply to the burner is shut down by closure of the magnetic valve. The burner can no longer be operated. Gas does not flow out.

f) The gas supply can be interrupted ahead of the gas intake 6 of the cock or valve 7, 8. The spark generator 3 seeks to ignite the burner anew and the module 2 shuts down the electromagnetic valve 5 either after X ignition attempts or after X seconds automatically, X being any selected number.

g) The gas flame 10 can be extinguished during operation. The module 2 applies a voltage to the spark generator to produce the spark and reignite the burner. If the burner can not be restored to operation, for example, if the burner covered is removed, the system is automatically shut down after X ignition attempts or after X seconds as has been described.

FIGS. 2 through 5 are pulse diagrams illustrating different situations which arise in use. In these figures, time is plotted along the abscissa and the pulse in height along the ordinate. In the diagrams:

S1: switch state of the switch S1, 12 as controlled by the stem 7. 0=off; 1=full or partial burn (high or low flame)

A1/A2: the current required to hold the electromagnetic of the valve in the open state, 9=no current, 1=current supply.

A3/E3: the spark between the spark plug 3 and the burner.

10: the burning flame, 0=off, 1=flame burns

9: the supply voltage to the module 2.

Figure 2:
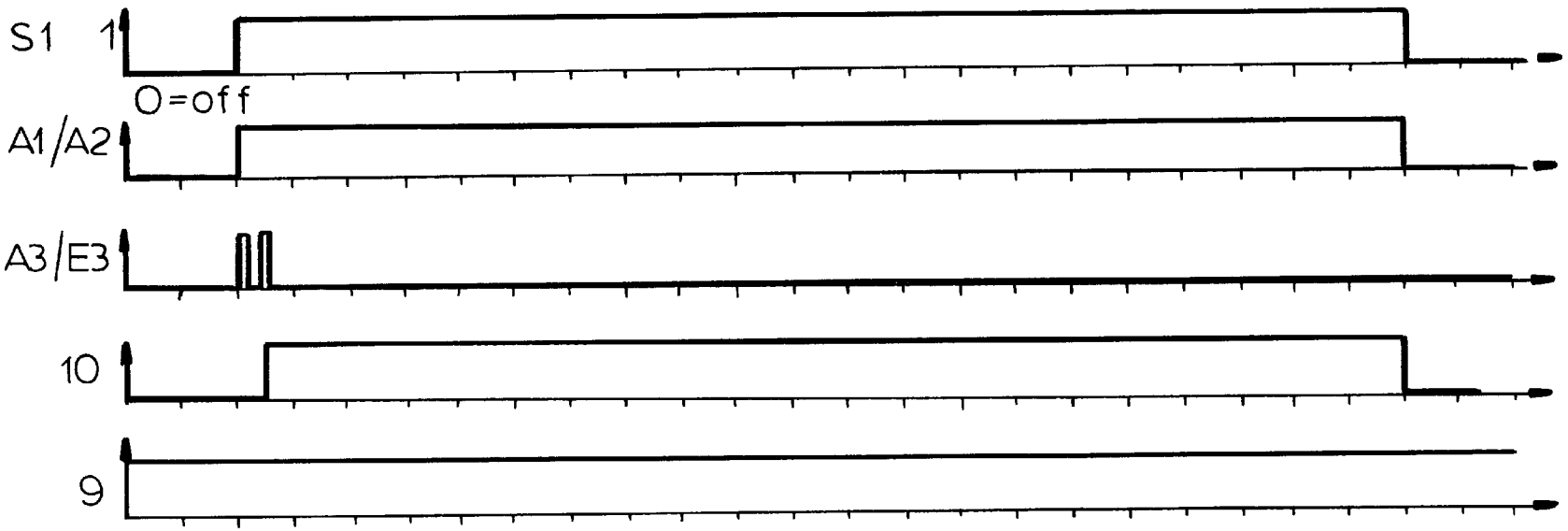
FIGS. 2 through 5 are pulse diagrams showing various situations which can arise in use.

FIG. 2 shows the normal use state. The burner is in operation. The flame burns after two ignition pulses. The burner is shut down after working is complete.

Figure 3:
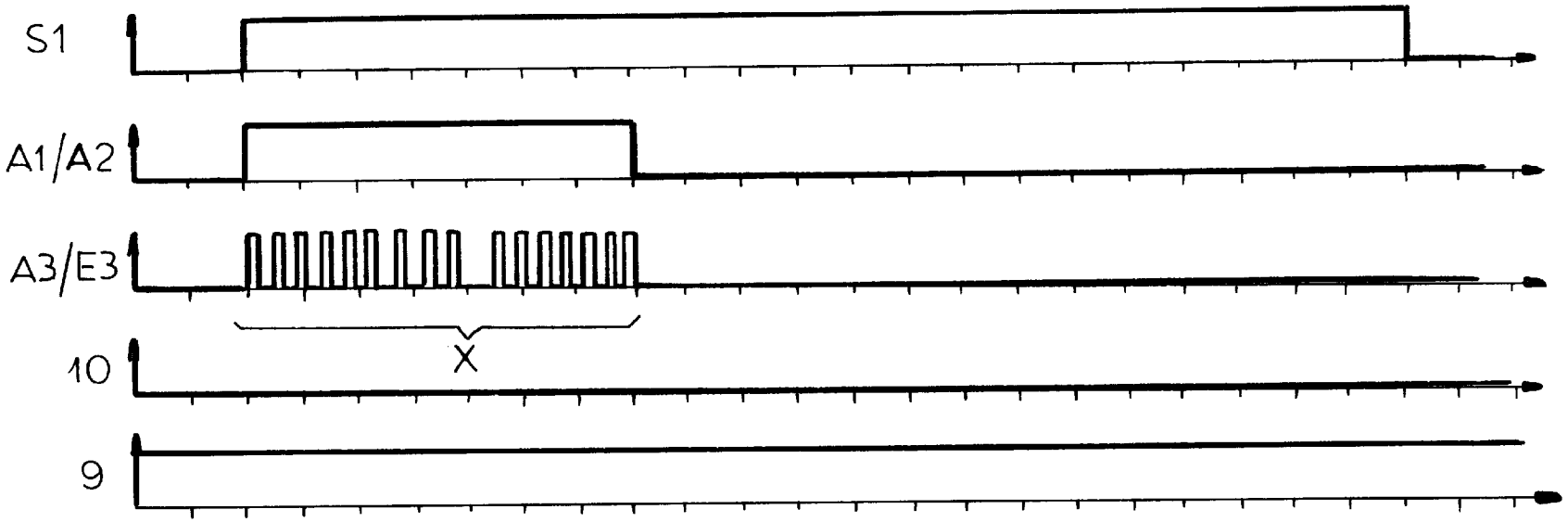

The diagram of FIG. 3 shows the state when the burner gas is off. After X ignition pulses, the flame remains off. The current supply to the magnetic valve is interrupted. The system shuts down.

Figure 4:
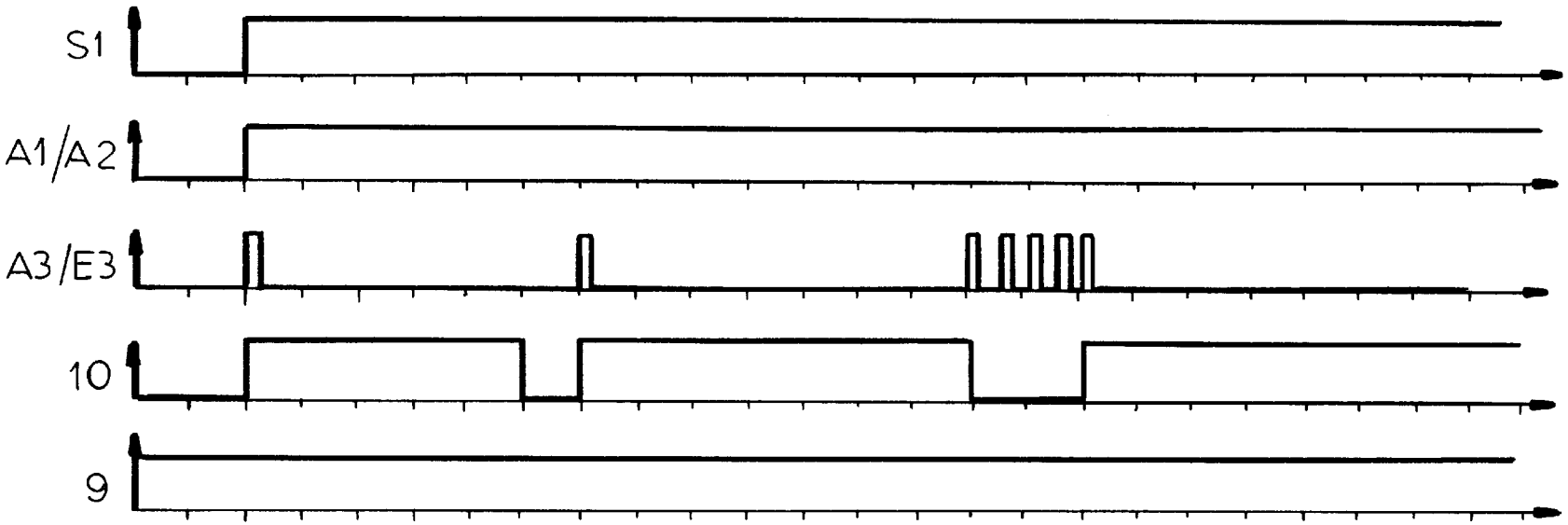

FIG. 4 shows the normal state. The burner is turned on and the flame burns after an ignition pulse. After 5 time intervals the flame is blown out and reignition is activated. The burner resumes burning after some time, the flame is blown out again. The flame is then caused to burn again at the burning of the fifth reignition pulse.

Figure 5:
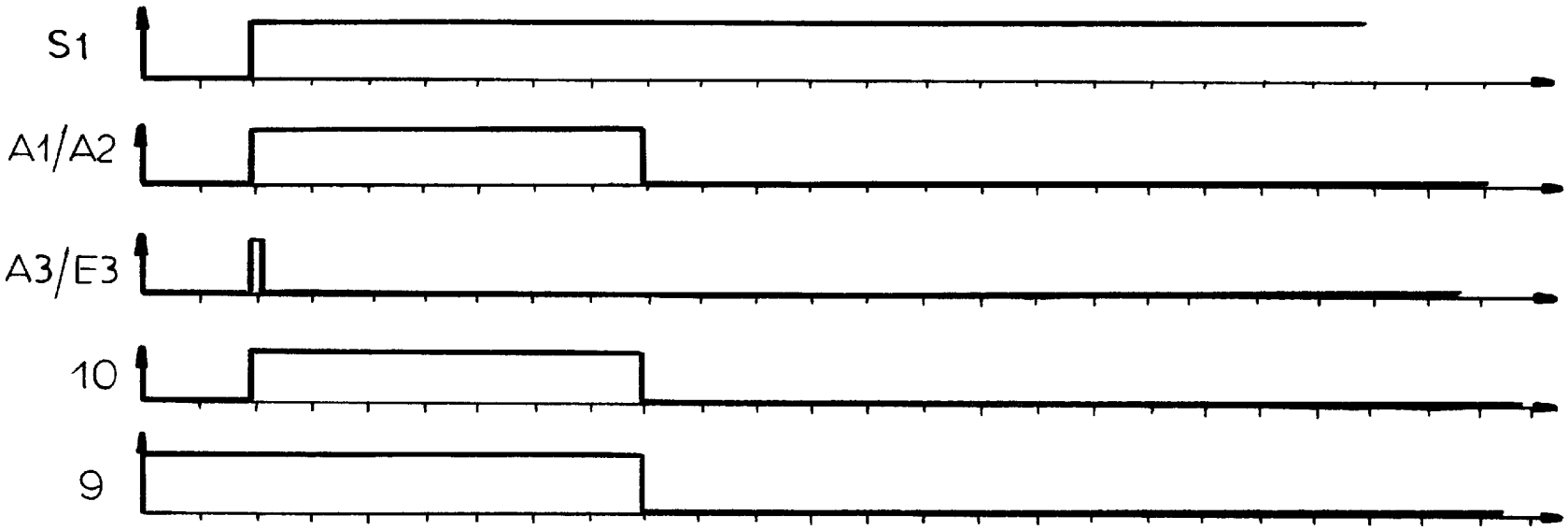

FIG. 5 shows the normal operating state. When the burner is turned on, the flame burns after a single initial pulse. After 5 time units the supply voltage is interrupted, the current to the magnetic valve is interrupted and the gas flow is stopped.

In an alternative, the electromagnetic valve is located in the gas cock and is not external thereof. An embodiment has been proved to be highly advantageous in which, when there are a number of control burner stations, only the burner stations which cannot be reignited are shut down rather than all of the burner stations.

I claim:

1. A gas burner system comprising:

a gas cooking burner;

a gas supply line connected to said gas burner for supply a fuel gas thereto;

an electromagnetic valve connected in said gas supply line for shutting off a supply of gas to said burner upon extinguishing of a burner flame;

a spark generator at said burner receiving a voltage pulse for producing a spark to ignite said flame at said burner and for signaling discharge of unburned fuel gas therefrom;

an electronic controller connected between said spark generator and said electromagnetic valve for automatically triggering a series of voltage pulses producing respective sparks to attempt to ignite unburned fuel gas and, upon a failure of ignition within a predetermined time interval or after a predetermined number of pulses, closing said electromagnetic valve; and a manually operable valve connected in said line, said manually operable valve having a valve stem for controlling supply of gas to said burner through said line, said electronic controller generating a retention current maintaining said electromagnetic valve in an open state over an entire duration of the burner flame;

said electromagnetic valve being spring biased toward a closed state, said stem producing, upon a single actuation of said stem, a retention current maintaining said electromagnetic valve in an open state over an entire duration of the burner flame.

2. The gas burner system defined in claim 1, further comprising a switch operatively connected to said stem and electrically in circuit with said controller for switching said controller on and off in response to actuation of said stem.

3. The gas burner system defined in claim 2, further comprising a housing for said manually operable valve, said electromagnetic valve being located in said housing.

4. The gas burner system defined in claim 3, wherein said switch is a microswitch.

5. The gas burner system defined in claim 4, wherein said burner is one of a plurality of such burners, only burners of said plurality which are not re-ignitable being shut off from gas supply.

6. A gas burner system comprising:

a gas cooking burner;

a gas supply line connected to said gas burner for supply a fuel gas thereto;

an electromagnetic valve connected in said gas supply line for shutting off a supply of gas to said burner upon extinguishing of a burner flame;

a spark generator at said burner receiving a voltage pulse for producing a spark to ignite said flame at said burner and for signaling discharge of unburned fuel gas therefrom; and an electronic controller connected between said spark generator and said electromagnetic valve for automatically triggering a series of voltage pulses producing respective sparks to attempt to ignite unburned fuel gas and, upon a failure of ignition within a predetermined time interval or after a predetermined number of pulses, closing said electromagnetic valve; and a manually operable valve connected in said line, said manually operable valve having a valve stem for controlling supply of gas to said burner through said line, said electromagnetic valve being spring biased toward a closed state and said valve stem producing, upon a single actuation of said stem, a retention current maintaining said electromagnetic valve in an open state over an entire duration of the burner flame.

7. The gas burner system defined in claim 6, further comprising a housing for said manually operable valve, said electromagnetic valve being located in said housing.

8. The gas burner system defined in claim 6, wherein said switch is a microswitch.

9. A gas burner system comprising:

a gas cooking burner;

a gas supply line connected to said gas burner for supply a fuel gas thereto;

an electromagnetic valve connected in said gas supply line for shutting off a supply of gas to said burner upon extinguishing of a burner flame;

a spark generator at said burner receiving a voltage pulse for producing a spark to ignite said flame at said burner and for signaling discharge of unburned fuel gas therefrom; and an electronic controller connected between said spark generator and said electromagnetic valve for automatically triggering a series of voltage pulses producing respective sparks to attempt to ignite unburned fuel gas and, upon a failure of ignition within a predetermined time interval or after a predetermined number of pulses, closing said electromagnetic valve;

a manually operable valve connected in said line, said manually operable valve having a valve stem for controlling supply of gas to said burner through said line; and a switch operatively connected to said stem and electrically in circuit with said controller for switching said controller on and off in response to actuation of said stem.

* * * * *